US005821967A

United States Patent [19]

Solero

[11] Patent Number: 5,821,967

[45] Date of Patent: Oct. 13, 1998

[54] HOLDER FOR REFILLING AN INK JET PRINTHEAD

[75] Inventor: Giorgio Solero, Turin, Italy

[73] Assignee: Baltea, S.p.A., Ivrea, Italy

[21] Appl. No.: 622,454

[22] Filed: Mar. 22, 1996

[30] Foreign Application Priority Data

Oct. 23, 1995 [IT] Italy ..... T09500231 U

[51] Int. Cl.[6] ..... B41J 2/175

[52] U.S. Cl. ..... 347/87

[58] Field of Search ..... 347/84–87; 141/18, 141/329, 330, 364–366; 220/256, 259

[56] References Cited

U.S. PATENT DOCUMENTS

| | | | |
|---|---|---|---|
| 1,045,927 | 2/1912 | Ostberg | 220/259 |
| 2,753,051 | 7/1956 | Tupper | 220/259 |
| 5,119,115 | 6/1992 | Buat et al. . | |
| 5,495,877 | 3/1996 | Schwenck et al. | 141/370 |

FOREIGN PATENT DOCUMENTS

| | | | |
|---|---|---|---|
| 3-180354 | 4/1991 | Japan | 347/29 |
| 5-270002 | 10/1993 | Japan | 347/85 |
| 6-106730 | 4/1994 | Japan | 347/7 |

*Primary Examiner*—Mark J. Reinhart
*Attorney, Agent, or Firm*—Banner & Witcoff, Ltd.

[57] ABSTRACT

A holder (10) for refilling an ink jet printhead (11) comprises a box (21) and two covers (22, 23), pivoted upwardly on the box (21) for being rotatable reciprocally and with respect to the box (21). A first cover (22) is provided for positioning and locking the printhead (11) into the box (21). A second cover (23) is superimposable to the first cover (22) and is provided with a seat (30) for being coupled with a refill cartridge (34) so as to refill the printhead (11). A short tube (31) is mounted in the second cover (23) inside the seat (30) to allow ink to pass from the cartridge (34) to the printhead (11) for refilling the latter. Pivoting of the two covers (22 and 23) allows simple and exact positioning of the same covers with respect to the printhead (11), first to lock it into the box (21) and then to fill the printhead (11) with ink.

9 Claims, 1 Drawing Sheet

HOLDER FOR REFILLING AN INK JET PRINTHEAD

FIELD OF THE INVENTION

The present invention relates to a holder for refilling an ink jet printhead by means of a refill cartridge, comprising a box for removably housing the printhead, a first cover for positioning and locking the printhead into the box and a second cover for being superimposed to the first cover.

BACKGROUND OF THE INVENTION

Ink jet printheads are commonly used in various printing devices, in which the ink jet printheads are generally mounted on a print carriage that is movable with respect to a print line. An example of these printheads is described in the U.S. Pat. No. 5,119,115. In particular, each printhead is provided with a tank which is filled with ink and which becomes empty in consequence of emission of droplets of ink from nozzles of the printhead.

In order to increase the operative life of printheads, the latter are refilled several times by filling up their tank with fresh ink. Normally refilling is performed by means of a cartridge containing ink and by transferring the ink from the cartridge into the tank of the printhead through a refill hole which is generally disposed on an outer surface of the printhead, usually opposite the side on which the nozzles are provided.

It is known a holder adapted for facilitating refilling of ink jet printheads, which comprises a box in which the printhead is housed and a cover which is removably mounted on a top of the box. The cover is provided with a tube which, when the cover is mounted on the top of the box, is positioned with respect to the printhead housed into the box, so that an end of the tube enters into the refill hole of the printhead and another end of the tube is disposed towards the outside of the holder for being coupled with the cartridge and so reaching the ink contained in the same cartridge. In this manner, the tank of the printhead is put in communication with the ink contained in the cartridge, for causing the ink to pass through the tube from the cartridge to the tank, so as to refill the printhead.

In this known holder the cover is separate from the box and, therefore, the cover is completely removed from the box each time the printhead has to be housed inside the holder for being refilled.

Consequently, this holder is uncomfortable to use and requires a certain manual skill in mounting and correctly positioning the cover on the box for precisely positioning the tube with respect to the refill hole of the printhead housed in the box.

SUMMARY OF THE INVENTION

The purpose of this invention is to obtain a holder for refilling an ink jet printhead that is easier and more practical to use than those known in the state of the art described above.

This purpose is reached by the holder according the present invention, which comprises a first cover pivotably mounted on the box and rotatable from a rest position to a locking position for positioning and locking the printhead into the box; a second cover pivotable with respect to the box for being superimposed to the first cover, and a tube mounted on the second cover and having a first end for entering into said printhead and a second end for entering into the refill cartridge for allowing the passage of ink from the refill cartridge to the printhead, so that the tube is exactly positioned with respect to a predetermined point of the printhead lodged in the box, when the first cover is in the locking position and the second cover is superimposed to the first cover.

BRIEF DESCRIPTION OF THE DRAWINGS

This and other characteristics and advantages of the present invention will be clear from the following description of a preferred embodiment of the present invention which is given by way of a non-limiting example, with reference to the accompanying drawings, in which.

DETAILED DESCRIPTION OF THE PREFERRED EMBODIMENT

Figure 1:
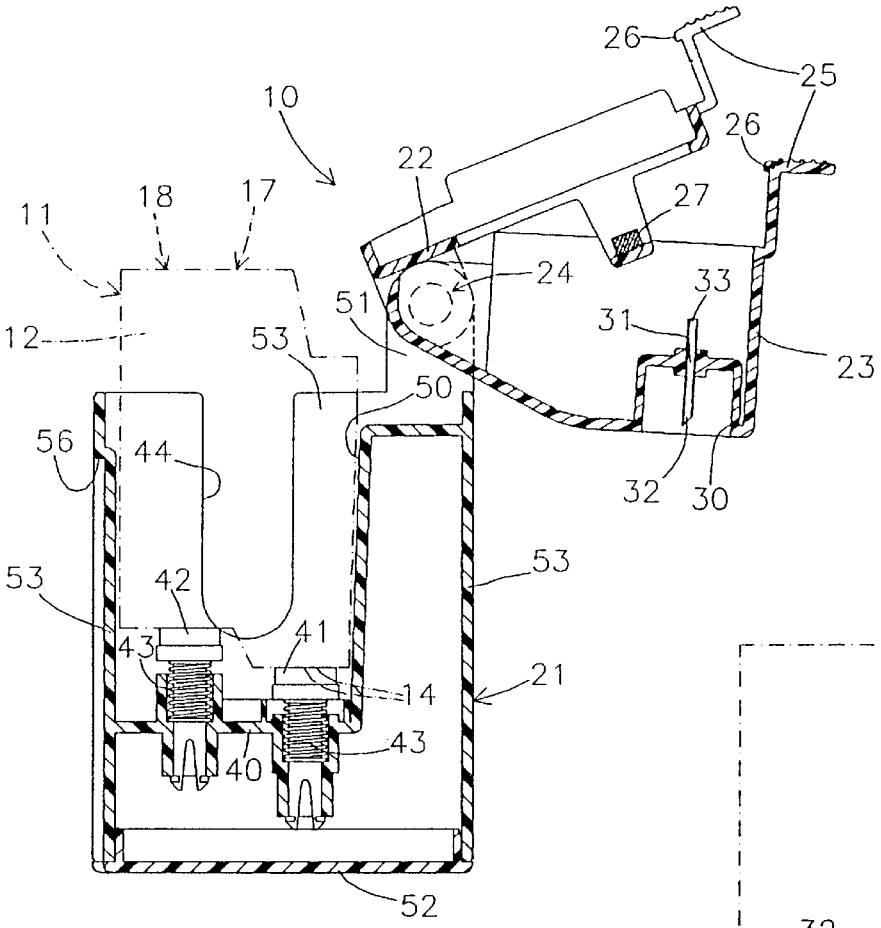
FIG. 1 is a lateral cross-sectional view of a holder for ink jet printheads in accordance with the present invention, in a rest position.

With reference to FIG. 1, a holder 10 for an ink jet printhead 11, according to the present invention, has a substantially parallelepipedal shape and comprises a box 21 and an upper part, which is constituted by two covers 22 and 23, respectively named first cover and second cover. The box 21 has a base 52 and four sides 53 which extend upwardly from the base 52 and which define a cavity 50. The sides 53 have an upper edge which define an aperture for entering the cavity 50. The covers 22 and 23 are pivoted, by means of a hinge 24, on parts 51 projecting upwardly from two sides 53. The hinge 24 defines a pivoting axis which is the same for the covers 22 and 23.

The first cover 22 can be selectively rotated with respect to the box 21 from a rest position, in which it does not close the aperture of the cavity 50 and permits the printhead 11 to be introduced 11 into the box 21, and a locking position in which it closes the aperture of the cavity 50 for locking the printhead 11 into the box 21.

Figure 2:
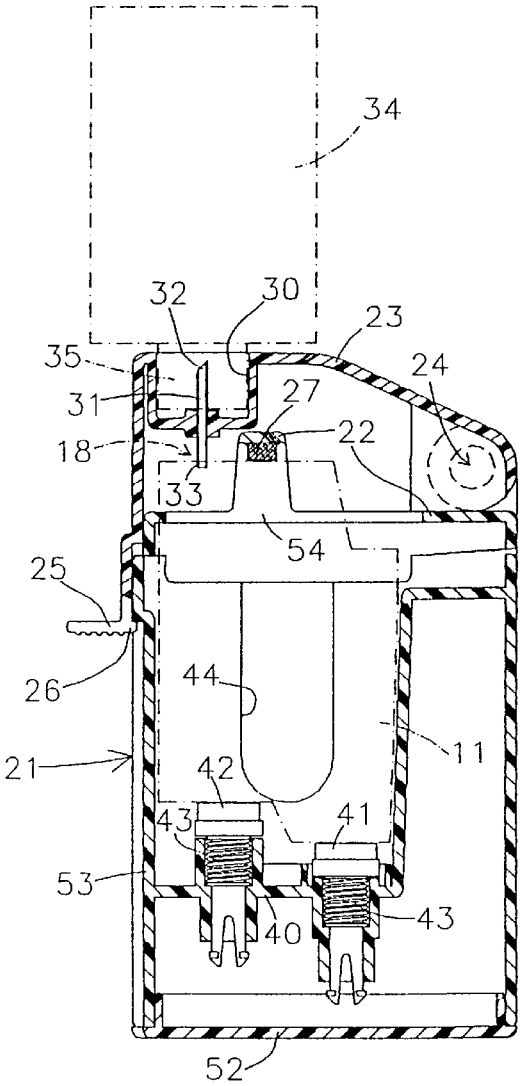
FIG. 2 is the holder of FIG. 1 in an operating position.

The second cover 23 is rotatable independently from the first cover 22 with respect to the box 21 and can be superimposed to the first cover 22, in particular when the latter is in the locking position shown in FIG. 2 The printhead 11 is shown schematically with a broken, dotted line and has a body 12, an internal tank for containing ink, a lower face bearing nozzles 14 for emission of the ink and an upper face in which a hole 17 is normally provided for putting in communication the interior of the printhead 11 with the outside. The hole 17 has the scope of maintaining the ink contained in the tank at a predetermined pressure with respect to the external atmospheric pressure. Moreover a refill hole 18 normally is provided on the upper face, which refill hole 18 is in communication with the tank inside the printhead 11 for allowing the refilling of the tank with fresh ink, as will be described later.

One side 53 of the box 21 is provided with a vertically-oriented aperture 44 which, when the printhead 11 is housed into the box 21, can allows observation of the ink inside, for example through transparent areas in the body 12 of the print head 11 or by some other means. This aperture makes it possible to visually control refilling of the head 11 with ink during the refill process.

The first cover 22 has a lower edge having a shape which substantially follows the profile of the of the upper edge of the box 21. The first cover 22 is also provided along its sides and adjacently to its lower edge with two ribs 54 for cooperating with the upper face of the printhead 11, when the latter is into the box 21. Only one of the ribs 54 is shown in the drawings since these ribs are located symmetrically with respect to the cross plane defining the sectional views of FIG. 1 and 2.

Moreover the two covers 22 and 23 are each provided, at their ends opposite to the hinge 24, with a tab 25 which can be manually operated to selectively rotate them. For hooking the covers 22 and 23 with respect to the box 21, both first cover 22 and second cover 23 are provided with a tooth 26 which is engageable with a single shoulder 56 in the box 21.

When the covers 22 and 23 are hooked to the box 21, the respective tabs 25 are perfectly aligned and permit a quick, easy and selective unhooking of the covers 22 and 23 from the box 21 for rotation in a clockwise direction (FIG. 1 and FIG. 2).

Similarly, hooking of the covers 22 and 23 to the box 21 is also very easy and fast, and does not require complex manipulations of the covers 22 and 23 as in the known art.

Arranged on the cover 22 is a rubber element 27 which, when the printhead 11 is housed in the box 21 and the cover 22 is rotated in its locking position, urges against the same printhead 11 in correspondence of its communication hole 17. In this way the rubber element 27 is able to close the communication hole 17 of the printhead 11 for controlling the pressure of the ink inside the tank, so as to prevent undesirable leakage of ink during and after ink refilling.

The second cover 23 is shaped as a dome having upwardly a seat 30 for receiving a tip 35 of a cartridge 34 which is filled with ink and which is employed for supplying this ink to the printhead 11 housed in the box 21. Similarly to the printhead 11, the cartridge 34 is represented schematically with a broken, dotted line.

A straight and short tube 31 is fixly mounted to the cover 23 and passes through the latter for extending outwards from opposite sides of the cover 23. The tube 31 has two ends 32 and 33, which protrude respectively into the seat 30 and towards the cavity 50 of the holder 10, when the cover 23 is hooked to the box 21 (FIG. 2).

The seat 30 is open towards the outside of the holder 10 to receive the tip 35 of the cartridge 34. The end 33 of tube 31 has a flat shape and is operable for removing a closing element which obstructs the refill hole 18, so allowing the end 33 itself to pass through the hole 18 and to enter the tank of the printhead.

The end 32 of tube 31 is tapered so as to be able to perforate the tip 35 which is of a resilient material. In this way the ink inside the cartridge 34 is put in communication with the tank in the printhead 11. The ink in the cartridge 34 can thus pass through the tube 31 and refill the tank into the printhead 11, either for the effect of gravity and/or of a slight depressure inside the tank.

The box 21 has in its cavity 50 a bottom 40 in which two rubber caps 41 and 42 are elastically mounted. A first rubber cap 41 has substantially the scope of abutting against the nozzles 14 so as to seal them during refilling of the printhead 11, while the second rubber cap 42 is provided for operating as a further, resilient support of the lower face of the printhead 11, when the latter is housed in the holder 10. The rubber caps 41 and 42 are supported by corresponding springs 43, which are arranged between the same rubber caps 41 and 42 and the bottom 40. The springs 43 are subject to yield when the printhead 11 is pushed towards the bottom 40 by the ribs 54 of the first cover 22 for locking and positioning exactly the printhead 11 into the box 21. This yielding happens in correspondence of the final portion of the rotation of the first cover 22 for reaching its locking position and is activated by the entering into contact between the printhead 11 and the ribs 54.

It is clear that the distance which extends between the rubber caps 41 and 42 and the first cover 22, when no printhead is housed into the box 21 and the first cover 22 is hooked to the box 21, is slightly less than the distance between the upper and lower faces of the printhead 11 which have to be engaged by the rubber caps 41 and 42 and the cover 22 respectively. Consequently, when the cover 22 is rotated in its locking position above the printhead 11 housed in the box 21, the rubber caps 41 and 42 yield opposing the action of the spring 43 and, advantageously, the same rubber caps 41 and 42 seal the nozzles 17 through a force having an exact value defined by the yielding of the springs 43.

In the preferred embodiment of the holder 10 described above, both the covers 22 and 23 are pivoted on the box 21. However it is evident that the same utility concept applied by the preferred embodiment, can serve to define other embodiments of the holder 10. As a non-exhaustive example, one only of the covers 22 and 23 may be pivoted on the box 21, whilst the other cover may be pivotally supported by that one only. Otherwise, the other cover may be linked to that one only cover in a way different from pivoting, for example, the other cover may be detachable for being completely removed from the box 21 each time that the printhead 11 has to be lodged inside.

It is evident that various changes and/or improvements may be made to the holder 10 for refilling the ink jet printhead corresponding to the preferred embodiment described in the foregoing without departing from the scope of the present invention.

What I claim is:

1. A holder for refilling an ink jet printhead by using a refill cartridge, comprising:

a box for removably lodging said printhead;

a first cover pivotably mounted on said box and rotatable from a rest position to a locking position for positioning and locking said printhead into said box;

a second cover pivotably mounted with respect to said box and on the same pivoting axis of said first cover for being superimposed to said first cover, each of said first cover and said second cover being provided with a manually actionable tab for rotating respectively said first cover and said second cover, and the tabs of said first cover and said second cover being arranged substantially aligned, one at the side of the other, when said first cover is closed in said locking position, and said second cover is superimposed to said first cover; and a tube mounted on said second cover and having a first end for entering into said printhead and a second end for entering into said refill cartridge for allowing a passage of ink from said refill cartridge to said printhead;

whereby said first end of said tube is exactly positioned with respect to a refill hole of said printhead, when said printhead is lodged in said box, said first cover is closed in said locking position, and said second cover is superimposed to said first cover; and the tabs of said first cover and said second cover are arranged substantially aligned, one at the side of the other, when said first cover and said second cover are lifted with respect to said box.

2. A holder according to claim 1, wherein a seat is provided in said second cover for removably housing said refill cartridge and for positioning it with respect to said tube.

3. A holder according to claim 2, wherein said second end of said tube is lodged within said seat.

4. A holder according to claim 1, wherein said first cover and said second cover are both pivoting between parts projecting upwardly of said box.

5. A holder according to claim 1, wherein said first end of said tube is provided for entering into an internal tank of said printhead through said refill hole.

6. A holder according to claim 5, wherein said first cover has means for sealing another hole of said printhead, when said printhead is lodged into said box and said first cover is in said locking position, said another hole being provided for maintaining the pressure of the ink into said tank at a predetermined value during the normal use of said printhead.

7. A holder according to claim 1, wherein said box is provided with a locking shoulder and wherein said each cover is provided with a tooth engageable with said locking shoulder.

8. A holder according to claim 1, wherein at least one elastic member is mounted on an internal bottom of said box for sealing a plurality of nozzles of said printhead, and wherein said first cover urges said printhead against the action of said elastic member, when said printhead is lodged in said box and said first cover is in said locking position.

9. A holder according to claim 1, wherein an aperture is provided on one side of said box to allow observation of said printhead when said printhead is lodged into said box.

* * * * *